US007586471B2

(12) United States Patent
Satoh et al.

(10) Patent No.: US 7,586,471 B2
(45) Date of Patent: Sep. 8, 2009

(54) DRIVE CIRCUIT AND DRIVE METHOD FOR PANEL DISPLAY DEVICE

(75) Inventors: Shinichi Satoh, Tokyo (JP); Naoya Kimura, Chiba (JP); Tetsuro Hara, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 748 days.

(21) Appl. No.: 11/190,850

(22) Filed: Jul. 28, 2005

(65) Prior Publication Data

US 2006/0022911 A1 Feb. 2, 2006

(30) Foreign Application Priority Data

Jul. 30, 2004 (JP) ..... 2004-223073

(51) Int. Cl.
*G09G 3/32* (2006.01)

(52) U.S. Cl. ..... 345/82; 345/204; 345/205; 345/211

(58) Field of Classification Search ..... 345/82, 345/204–205, 211
See application file for complete search history.

(56) References Cited

U.S. PATENT DOCUMENTS

| | | | | |
|---|---|---|---|---|
| 5,844,368 | A * | 12/1998 | Okuda et al. | 315/169.3 |
| 6,914,388 | B2 * | 7/2005 | Shin et al. | 315/169.2 |
| 2003/0085665 | A1 * | 5/2003 | Yoo | 315/169.3 |

FOREIGN PATENT DOCUMENTS

| | | |
|---|---|---|
| JP | 11-143429 | 5/1999 |
| JP | 11-311970 | 11/1999 |
| JP | 2001-286837 | 10/2001 |
| JP | 2003-223140 | 8/2003 |
| JP | 3507239 | 12/2003 |

* cited by examiner

*Primary Examiner*—Richard Hjerpe
*Assistant Examiner*—Leonid Shapiro
(74) *Attorney, Agent, or Firm*—Rabin & Berdo, P.C.

(57) ABSTRACT

Disclosed is a drive circuit for a panel display device for driving light-emitting devices arranged at respective intersections between a plurality of data lines and a plurality of scan lines. This drive circuit includes a voltage control circuit for charging the light-emitting devices to a voltage necessary for light emission by connecting the data lines to a predetermined power supply potential in a rising period prior to a period for selectively causing the light-emitting devices to emit light; and a drive control circuit for selectively connecting the data lines to a constant current source after the rising period.

14 Claims, 10 Drawing Sheets

DRIVE CIRCUIT AND DRIVE METHOD FOR PANEL DISPLAY DEVICE

BACKGROUND OF THE INVENTION

1. Field of the Invention

The present invention relates to a drive circuit and a drive method for a panel display device, and particularly to a drive circuit and a drive method for a panel display device which are capable of charging light-emitting devices at high speed.

2. Description of the Related Art

FIG. 9 illustrates an organic EL panel display device which has organic EL devices $PE_{P,Q}$ (P is an integer ranging from 1 to m; Q is an integer ranging from 1 to n) arranged at respective intersections between a plurality of data lines (anode lines) $SEG_1$ to $SEG_m$ (m is an integer no smaller than 2) and a plurality of scan lines (cathode lines) $COM_1$ to $COM_n$ (n is an integer no smaller than 2). A drive device of this organic EL panel display device has switch circuits $SWs_1$ to $SWs_m$ for connecting the data lines $SEG_P$ to respective constant current sources 11, and switch circuits $SWc_1$ to $SWc_n$ for connecting the respective scan lines $COM_Q$ to a power supply potential (Vcc) 20. A drive control circuit 10, or output control means, controls these switch circuits $SWs_P$ and $SWc_Q$ to select/deselect the organic EL devices $PE_{P,Q}$.

Now, typical operation for causing the organic EL panel display device to emit light for display will be described with reference to operating waveforms shown in FIG. 10. When the switch circuits $SWc_Q$ connecting to the scan lines $COM_Q$ are turned ON and OFF at a certain period of interval (which defines one frame), the scan lines $COM_Q$ on which the organic EL devices $PE_{P,Q}$ to be lit are arranged are sequentially selected. Here, the turned ON state is selected by connecting the scan lines $COM_Q$ to a ground potential Vss. The turned OFF state is selected by connecting the scan lines $COM_Q$ to the power supply potential Vcc. A single frame period $P_0$ is typically composed of a discharge period $P_1$ for discharging electric charges stored in the organic EL devices $PE_{P,Q}$, and a charge period $P_2$ for turning ON a single scan line $COM_Q$ to cause the selected organic EL device $PE_{P,Q}$ to emit light.

In the charge period, the switch circuit $SWs_P$ on the data line $SEG_P$ that is connected with the selected organic EL device $PE_{P,Q}$ is turned ON to connect the data line $SEG_P$ to the constant current source 11. As a result, the current from the constant current source 11 is supplied to cause the organic EL device $PE_{P,Q}$ to emit light. Here, the rows of the unselected scan lines $COM_Q$ and the unselected organic EL devices $PE_{P,Q}$ might undergo crosstalk and cause emission defects due to half-excited states of the organic EL devices $PE_{P,Q}$. To avoid this, control is usually performed to supply the potential of a power supply voltage level to the scan lines $COM_Q$ and to supply a potential of the GND level to the data lines $SEG_P$, thereby applying reverse biases to the organic EL devices $PE_{P,Q}$.

In the discharge period, for the sake of preventing residual charges in the previous frame from causing emission defects in the next frame, the ground potential Vss is applied to all the data lines $SEG_P$ and the scan lines $COM_Q$, thereby resetting charges stored in the organic EL devices $PE_{P,Q}$ to zero (the organic EL devices $PE_{P,Q}$ are zero-biased).

A related art of a drive circuit for an organic EL panel display device is disclosed, for example, in Japanese Patent No. 3507239.

In the related art of the drive circuit and the drive method for a panel display device, however, constant current sources are used for charging. The rise time required for charging up to a voltage necessary for light emission is long, thus causing such problems as deteriorated emission intensities of the organic EL devices $PE_{P,Q}$ and uneven display (variations in brightness).

SUMMARY OF THE INVENTION

According to one aspect of the present invention, there is provided a drive circuit for a panel display device for driving light-emitting devices arranged at respective intersections between a plurality of data lines and a plurality of scan lines. This drive circuit comprises: a voltage control circuit for charging the light-emitting devices to a voltage necessary for light emission by connecting the data lines to a predetermined power supply potential in a rising period prior to a period for selectively causing the light-emitting devices to emit light; and a drive control circuit for selectively connecting the data lines to a constant current source after the rising period.

According to another aspect of the present invention, there is provided a drive method for a panel display device for driving light-emitting devices arranged at respective intersections between a plurality of data lines and a plurality of scan lines. This drive method comprises the steps of: charging the light-emitting devices to a voltage necessary for light emission by connecting the data lines to a predetermined power supply potential in a rising period prior to a period for selectively causing the light-emitting devices to emit light; and selectively connecting the data lines to a constant current source after the rising period.

The drive circuit for a panel display device and the drive method for a panel display device according to the present invention accelerate the rise for charging up to the voltage necessary for light emission, thus enabling to charge at higher speed.

DETAILED DESCRIPTION OF THE INVENTION

Figure 1:
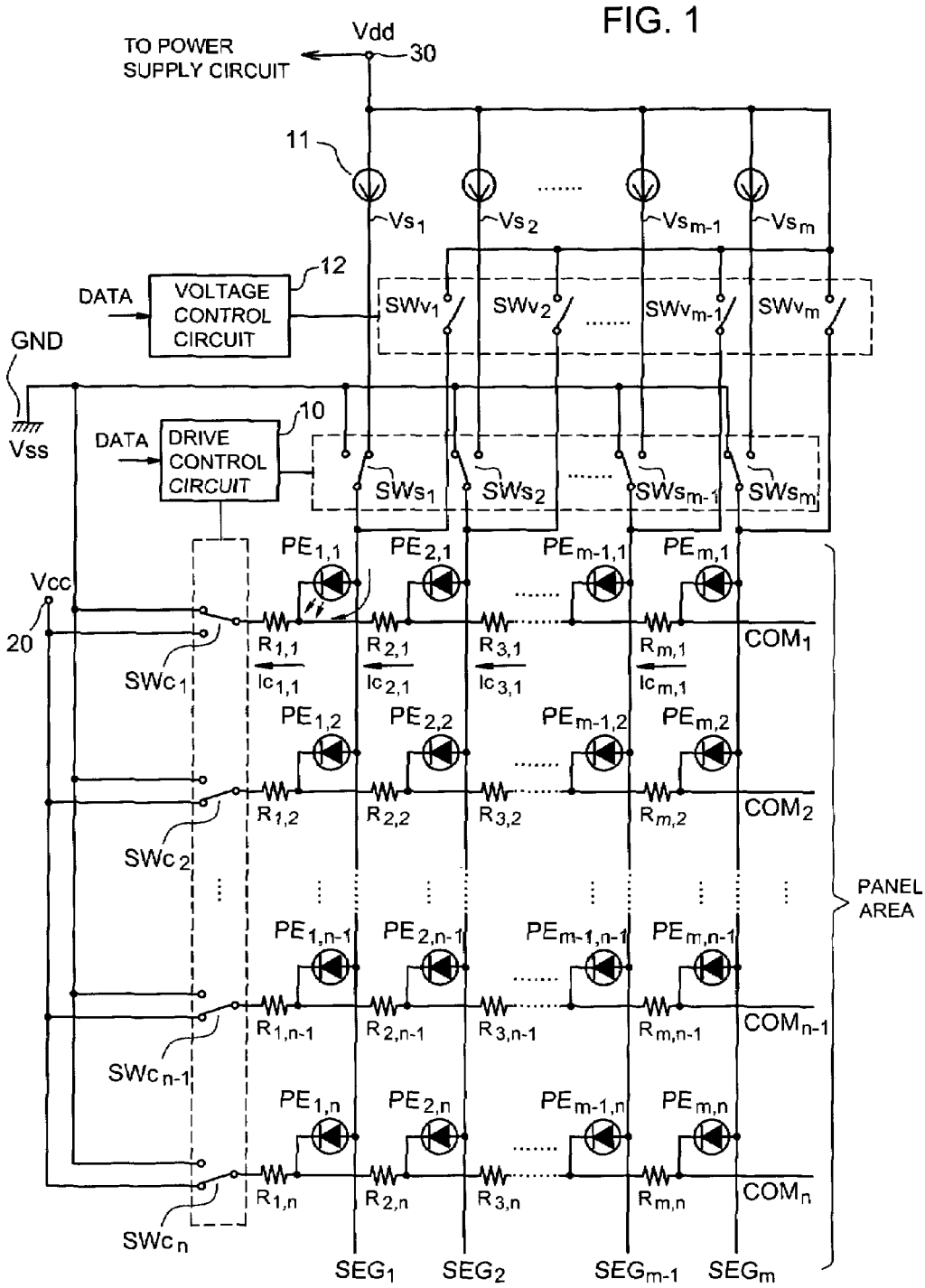
FIGS. 1 and 3-6 are block diagrams illustrating a drive circuit for a panel display device which is a first embodiment of the present invention.

Hereinafter, a best mode for carrying out the invention will be described with reference to the drawings. It should be noted that the shapes, dimensions, and layout of the individual components in the drawings are schematically illustrated only for the purpose of understanding of the present invention. It will nevertheless be understood that no limitation of the scope of the invention is thereby intended.

FIG. 1 is a block diagram illustrating a drive circuit for a panel display device which is a first embodiment of the present invention. The organic EL panel display device has light-emitting devices, or organic EL devices $PE_{P,Q}$ (P is an integer ranging from 1 to n; Q is an integer ranging from 1 to m), which are arranged at respective intersections between a plurality of data lines (anode lines) $SEG_1$ to $SEG_m$ and a plurality of scan lines (cathode lines) $COM_1$ to $COM_n$ (m and n are integers no smaller than 2).

The drive circuit for the panel display device according to the present invention comprises first switch circuits $SWs_P$, second switch circuits $SWc_Q$, and third switch circuits $SWv_P$. The first switch circuits $SWs_P$ connect the data lines $SEG_P$ to either respective constant current sources 11 or a ground potential Vss. The second switch circuits $SWc_Q$ connect the respective scan lines $COM_Q$ to either one of a scan line power supply 20 (power supply potential Vcc) and the ground voltage Vss. The third switch circuits $SWv_P$ connect the respective data lines $SEG_P$ to a data line power supply 30 (power supply potential Vdd). The first and second switch circuits $SWs_P$ and $SWc_Q$ are controlled by a drive control circuit 10, whereby the organic EL devices $PE_{P,Q}$ are selected/deselected. The third switch circuits $SWv_P$ selectively connect the data lines $SEG_P$ to the power supply potential Vdd in accordance with output of a voltage control circuit 12. Incidentally, the third switch circuits $SWv_P$ may be included in the voltage control circuit 12.

The first and second switch circuits $SWs_P$ and $SWc_Q$ are composed of PMOS transistors (P-channel MOS transistors) and NMOS transistors (N-channel MOS transistors) which can be controlled by control signals supplied from the drive control circuit 10, for example. The third switch circuits $SWv_P$ are composed of PMOS transistors and NMOS transistors which can be controlled by a control signal supplied from the voltage control circuit 12, for example. Incidentally, the first and second switch circuits $SWs_P$ and $SWc_Q$ may be included in the drive control circuit 10.

The voltage control circuit 12 connects a selected data line $SEG_P$ to the power supply potential Vdd during a rising period in which the organic EL devices $PE_{P,Q}$, i.e., capacitive loads are charged up to a voltage necessary for light emission. After this rising period, the voltage control circuit 12 disconnects the data line $SEG_P$ from the power supply potential Vdd. Subsequently, the drive control circuit 10 connects the data line $SEG_P$ to the constant current source 11.

Figure 7:
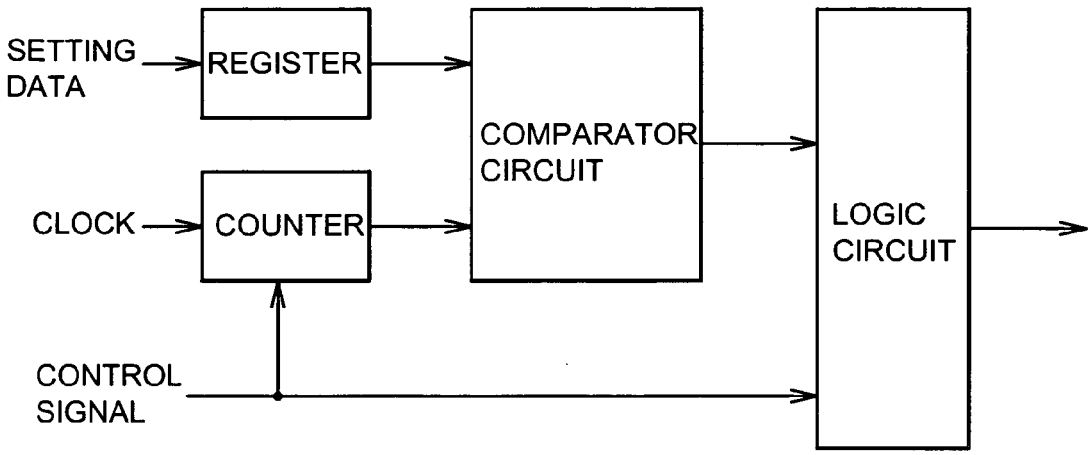
FIG. 7 is a block diagram of a voltage control circuit according to the first embodiment of the present invention.

As shown in FIG. 7, the voltage control circuit 12 comprises a register circuit, a counter circuit, a comparator circuit, and a logic circuit. Initially, when a control signal is input thereto, the voltage control circuit 12 turns ON a third switch circuit $SWv_P$ by the logic circuit. Next, when setting data indicating a desired time is supplied to the register circuit and the setting data coincides with count value of the counter circuit, the voltage control circuit 12 turns OFF the third switch circuit $SWv_P$ by the logic circuit based on output of the comparator circuit.

Now, with reference to the timing chart shown in FIG. 2, description will be given of the operation of driving the panel display device according to the first embodiment of the present invention.

In each single frame period, panel rows including the organic EL devices to be lit are successively selected by combinations of the turned ON state and turned OFF state of the switch circuits $SWc_Q$ which are connected to the scan lines $COM_Q$. Here, the turned ON state is selected by connection to the ground potential Vss. The turned OFF state is selected by connection to the power supply potential Vcc.

In the discharge period $P_1$, load charges on the organic EL devices $PE_{P,Q}$ which are capacitive loads are reset. In the charge period $P_2$, a scan line $COM_Q$ is turned ON so that the organic EL device $PE_{P,Q}$ that is selected and connected to this scan line $COM_Q$ emits light.

According to the first embodiment of the present invention, all the data lines $SEG_P$ and the scan lines $COM_Q$ are connected to the ground potential Vss in the discharge period $P_1$ so that the charges stored in the organic EL devices $PE_{P,Q}$ are reset to zero. Then, in the rising period $P_{12}$, the voltage control circuit 12 turns ON the switch circuits $SWv_P$ for a predetermined time so that the potentials of the data lines $SEG_P$ rise to a certain potential before the start of the charge period $P_2$.

Figure 2:
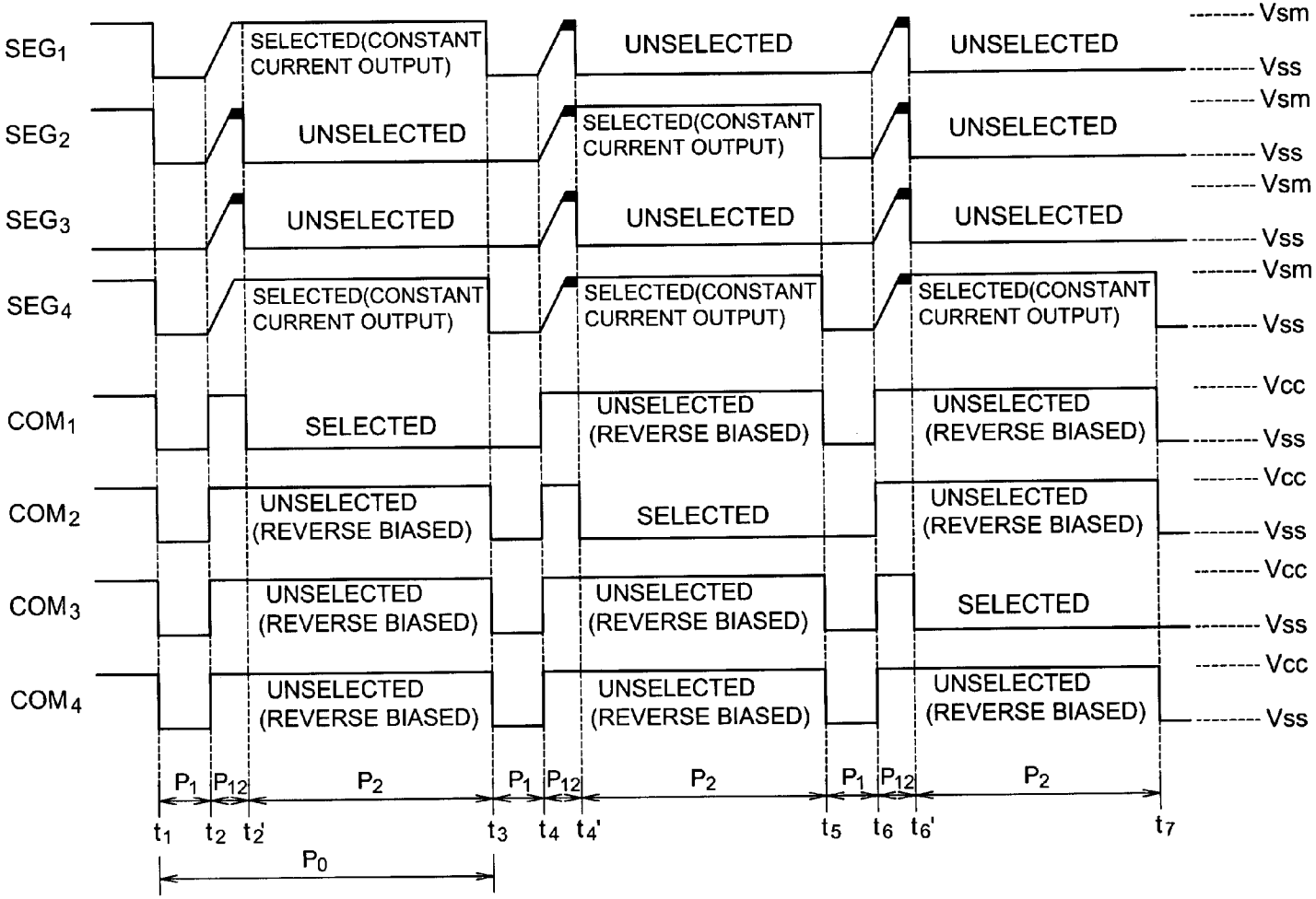
FIG. 2 is a timing chart for the purpose of illustrating operation of driving the panel display device of the first embodiment of the present invention.
Figure 3:
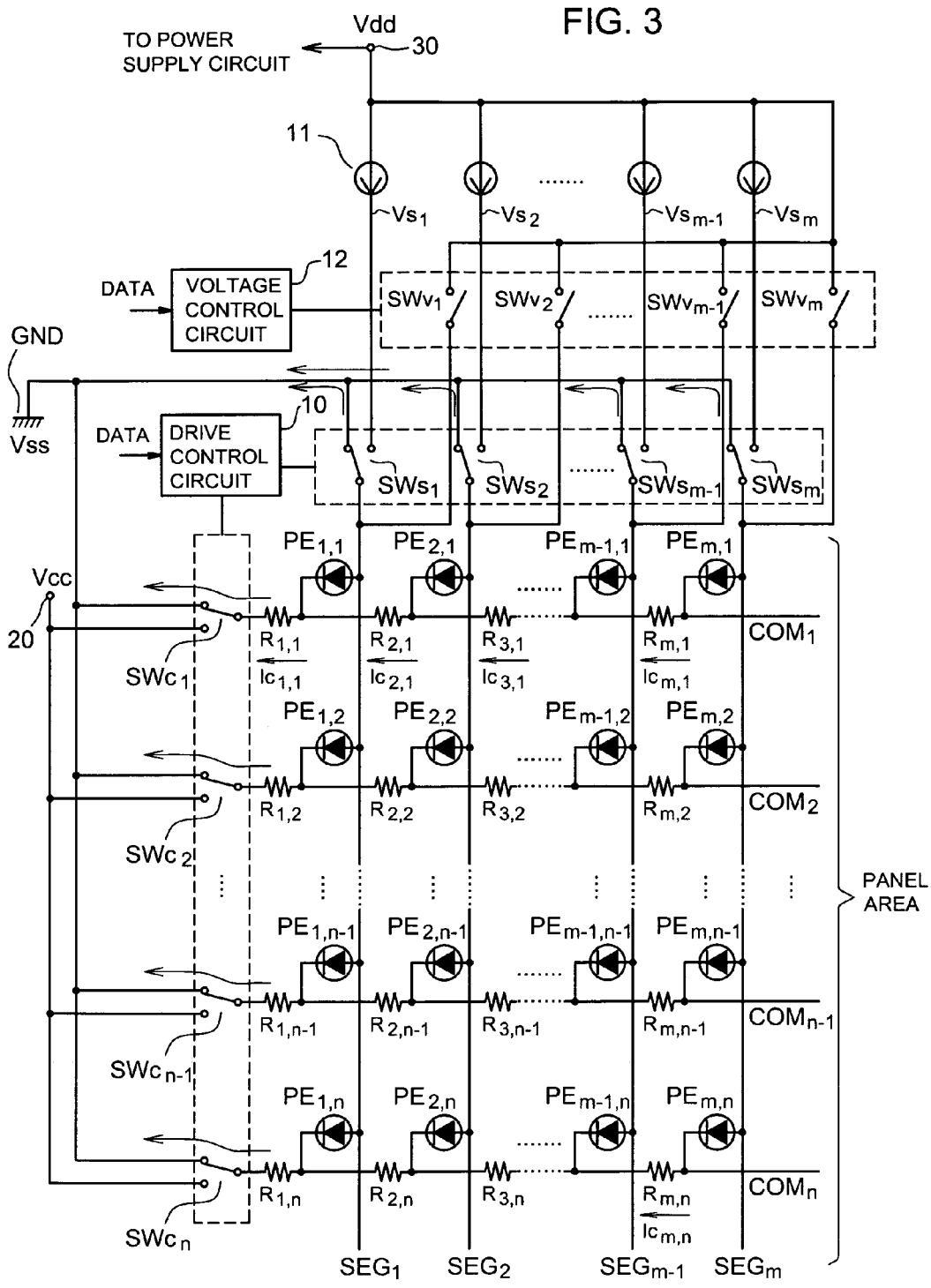
Figure 4:
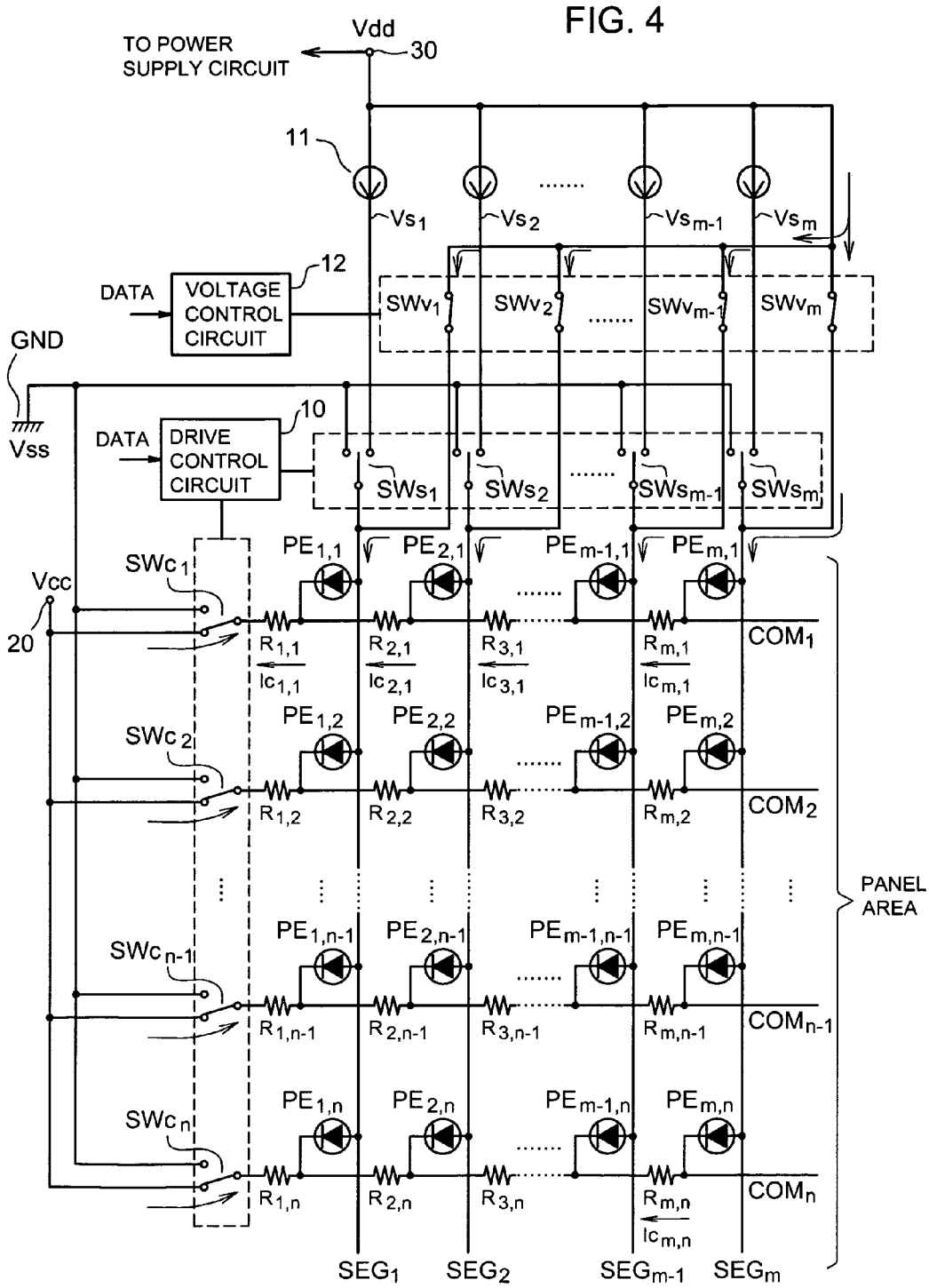
Figure 5:
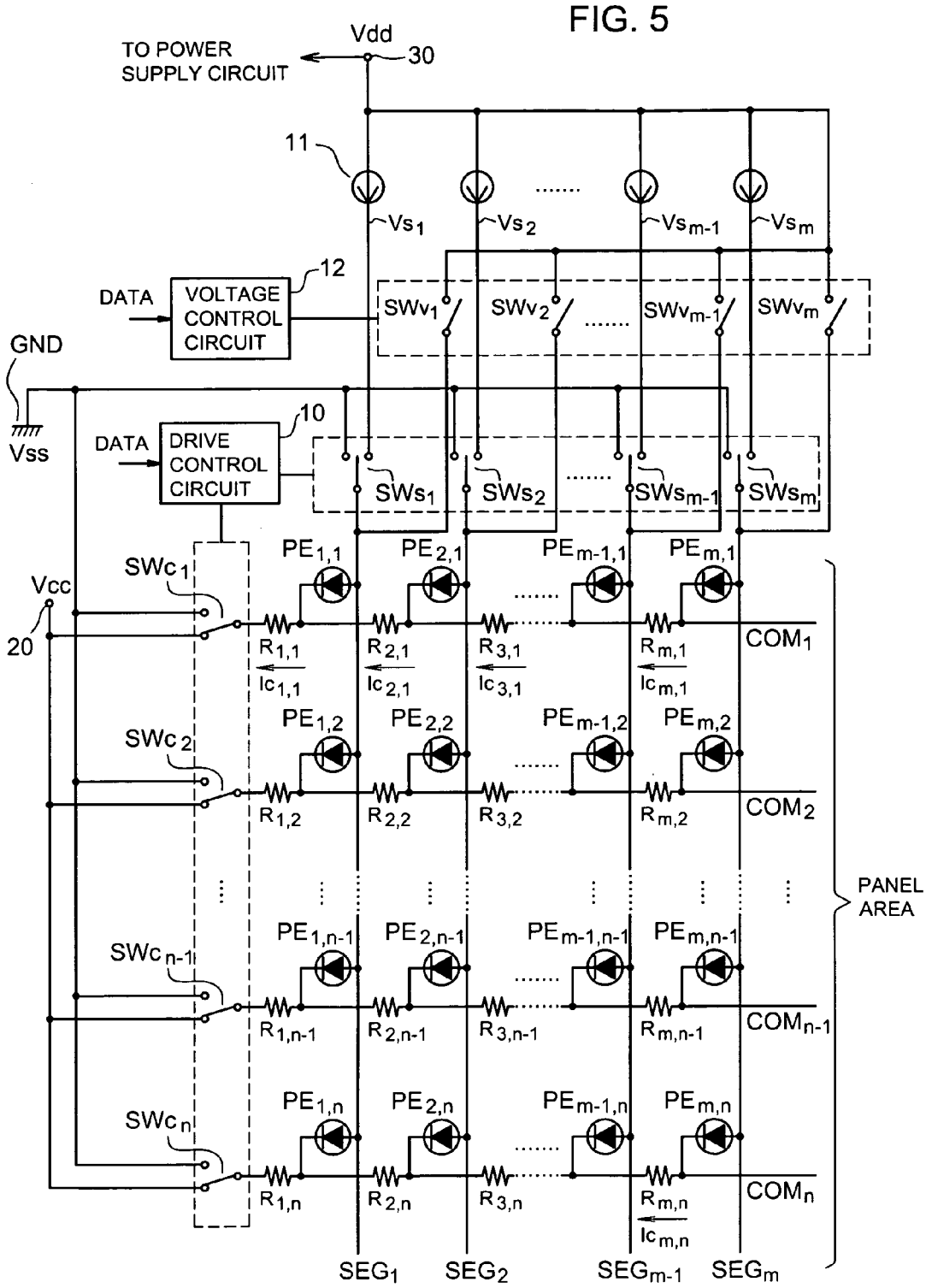
Figure 6:
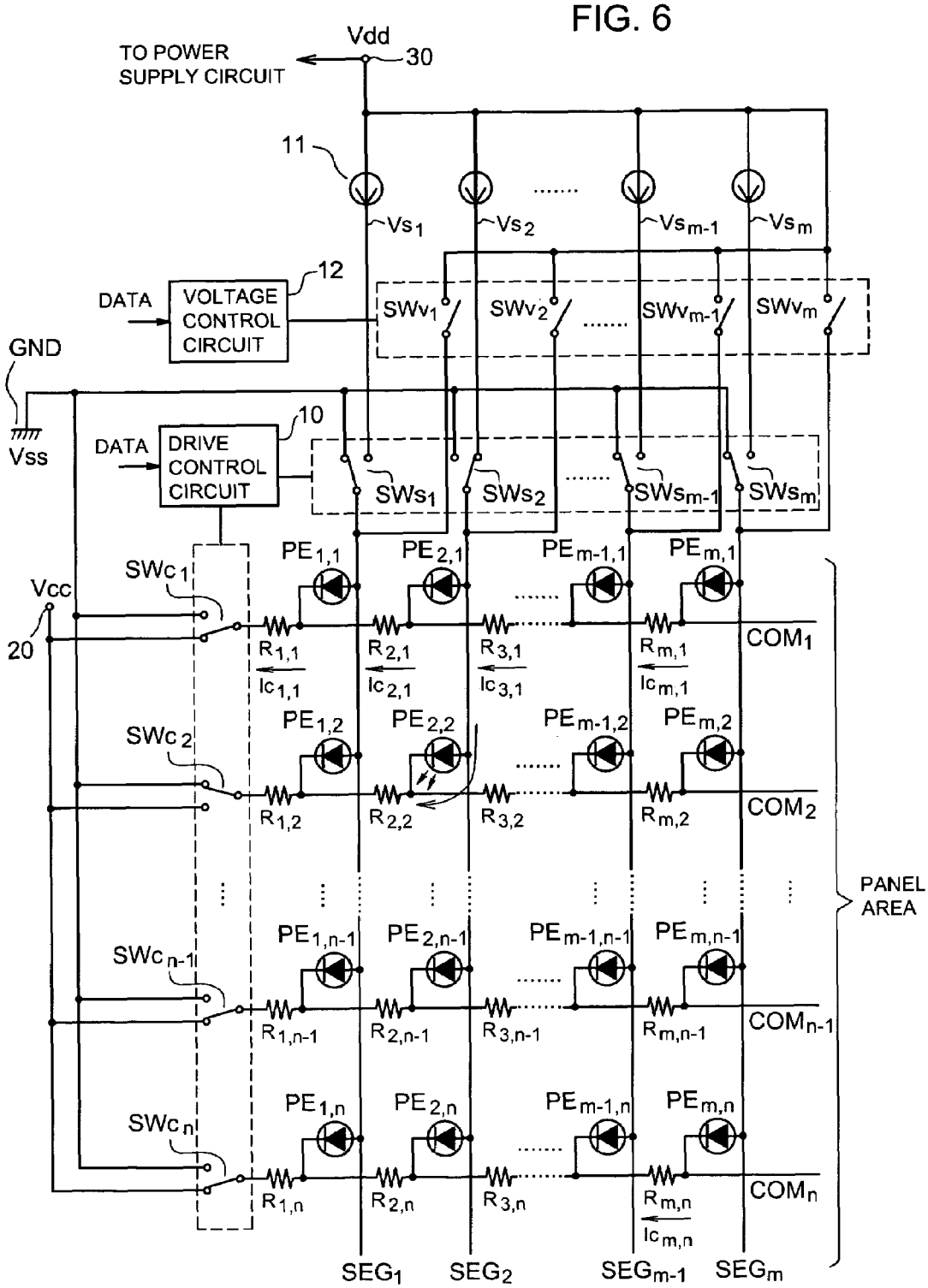

Specifically, as shown in FIG. 2, in the charge period $P_2$ (the period from t2' to t3), the switch circuit $SWs_1$ is initially connected to the constant current source 11 and the switch circuit $SWc_1$ is connected to the ground potential Vss so that the organic EL device $PE_{1,1}$ emits light. Next, as shown in FIG. 3, the discharge period is entered at time t3. Here, all the switch circuits $SWs_P$ and $SWc_Q$ are connected to the ground potential Vss, whereby the load charges on the organic EL devices $PE_{P,Q}$ are reset to zero. At time t4, the charge period is entered as shown in FIG. 4. Here, the switch circuits $SWs_P$ are turned OFF, and the switch circuit $SWc_1$ is connected to the power supply potential Vcc. Then, the voltage control circuit 12 turns ON the switch circuits $SWv_P$ to connect the organic EL devices $PE_{P,Q}$ to Vdd until time t4'. This charges the organic EL devices $PE_{P,Q}$ until their potentials reach a certain potential (target potential $Vs_P$). Subsequently, as shown in FIG. 5, the voltage control circuit 12 turns OFF the switch circuits $SWv_P$ so that the data lines $SEG_P$ are kept at a certain potential ($Vsm \pm \alpha$; $\alpha$ is arbitrary). At time t4', as shown in FIG. 6, the switch circuit $SWs_2$ is connected to the constant current source 11 immediately. The switch circuits on the unselected data lines are connected to the ground potential Vss, and the switch circuit $SWc_2$ is connected to the ground potential Vss so that the organic EL device $PE_{2,2}$ emits light.

As described above, according to the first embodiment of the present invention, there are provided the voltage control circuit 12 and the switch circuits $SWv_P$. When the light-emitting devices are selected, the light-emitting devices are connected to the power supply potential (Vdd) for a predetermined time during the rising period $P_{12}$ of the charge period, and then connected to the constant current supply sources after this predetermined time. This consequently allows high speed charging. Since the ON times of the switch circuits $SWv_P$ can be adjusted by the voltage control circuit 12, it is possible to adjust the charging capability. Consequently, the potentials of the data lines can be set to a certain potential, which makes it possible to adjust the potential setting in accordance to load characteristics of the panel. Moreover, the voltage control circuit 12 is configured so as not to supply a certain potential based on a voltage generated by a regulator. This allows a reduction in circuit scale.

Figure 8:
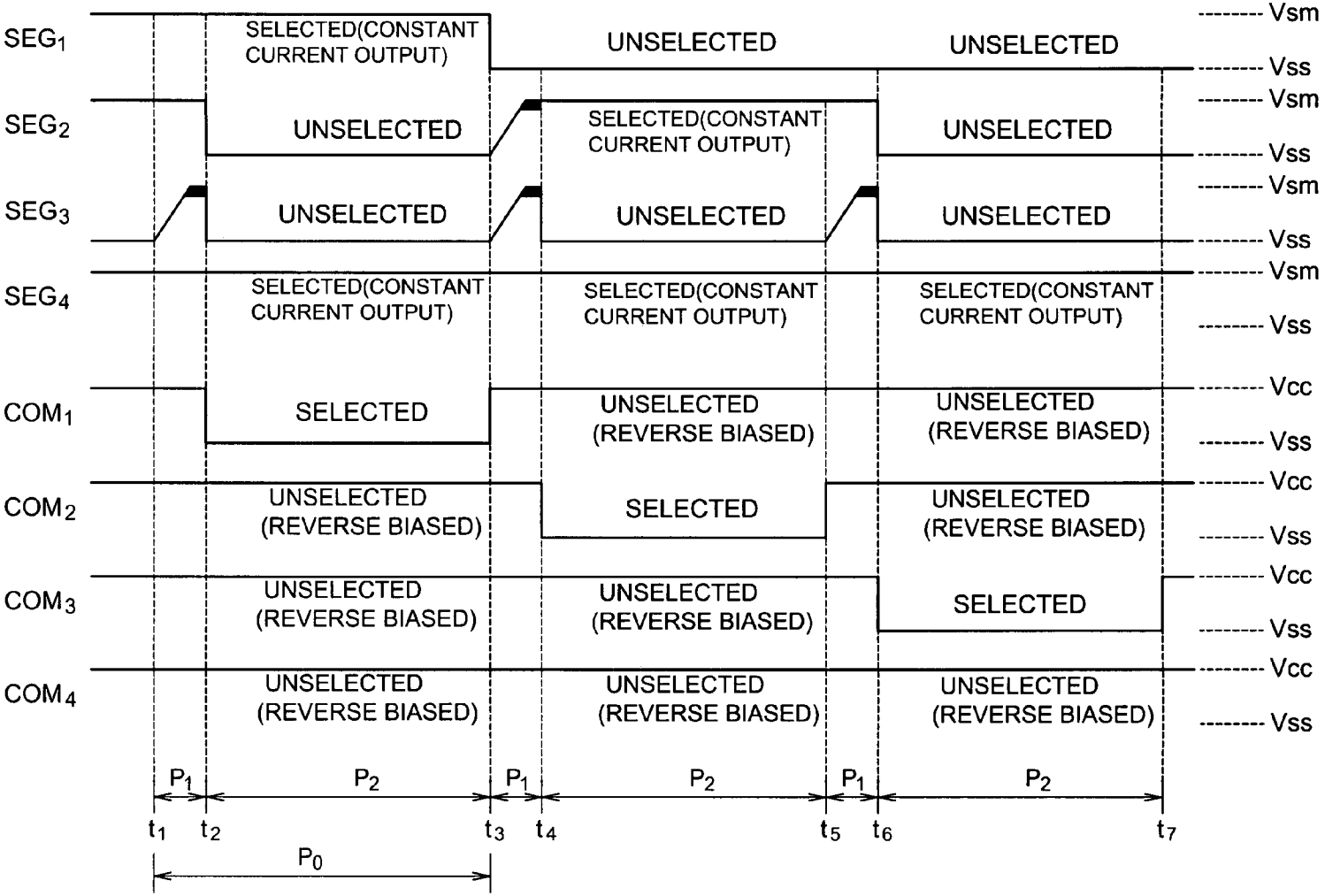
FIG. 8 is a timing chart for the purpose of illustrating operation of driving the panel display device according to a second embodiment of the present invention.
Figure 9:
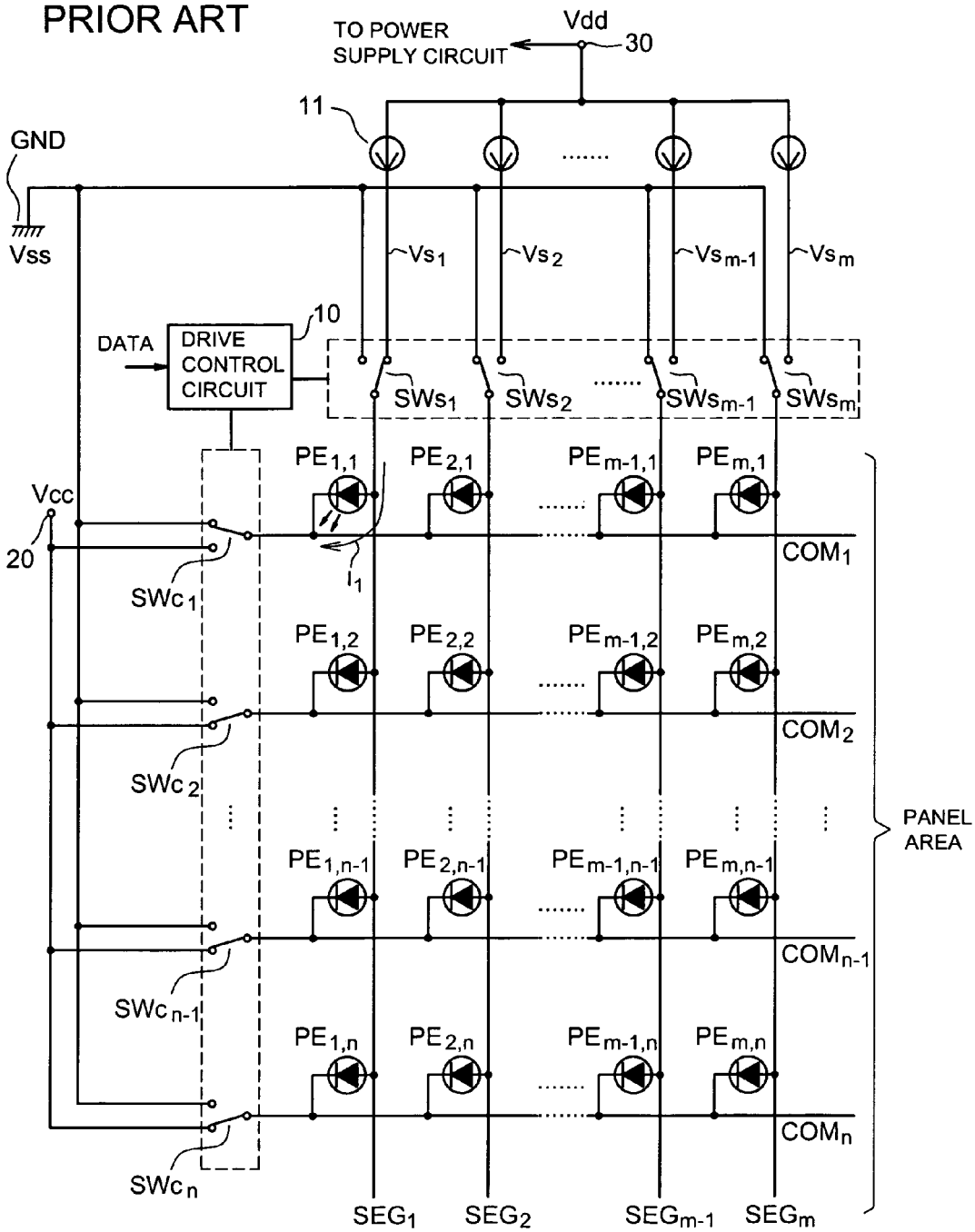
FIG. 9 PRIOR ART
FIG. 9 is a block diagram of a drive circuit for a conventional panel display device.
Figure 10:
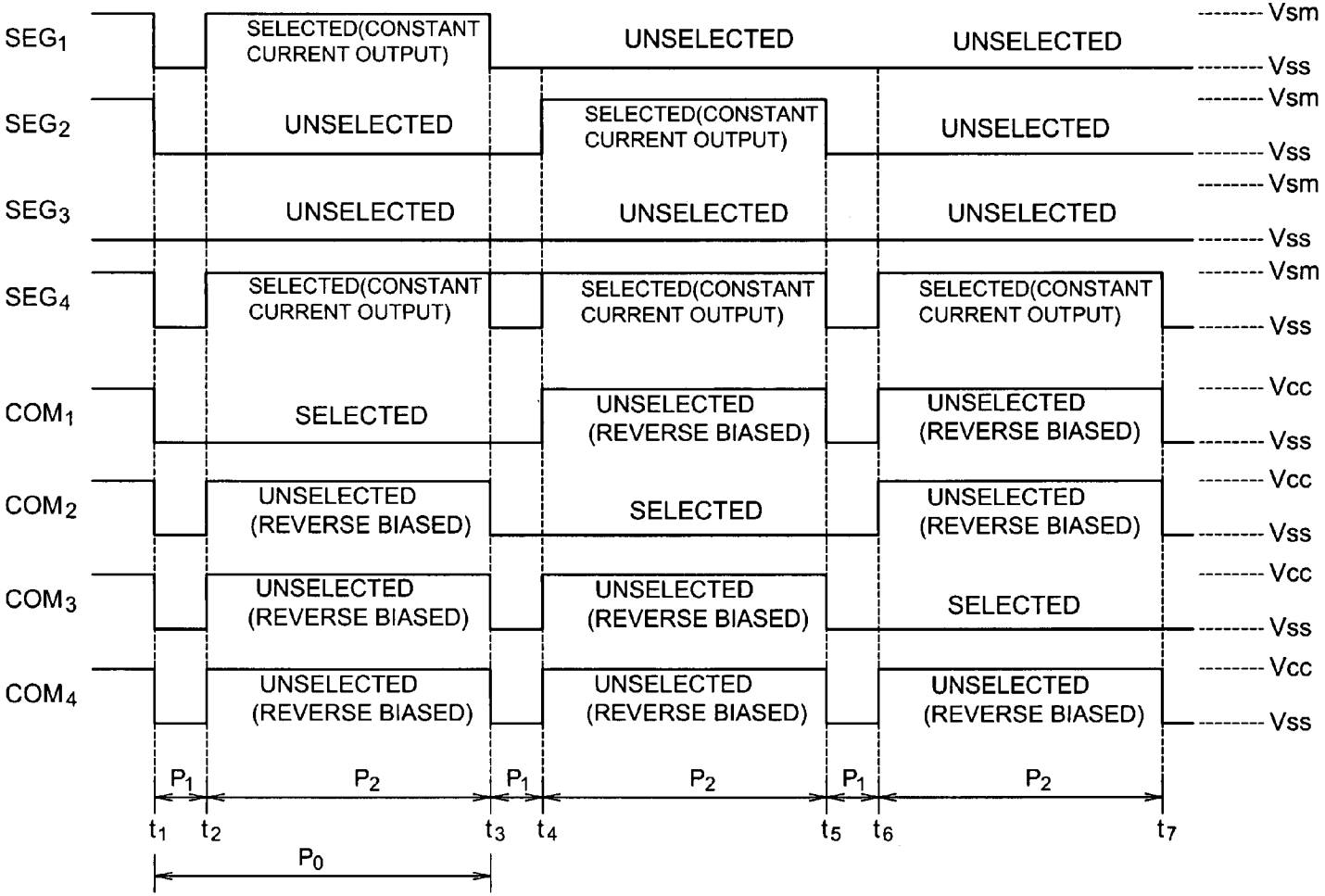
FIG. 10 PRIOR ART
FIG. 10 is a timing chart for the purpose of illustrating operation of driving the conventional panel display device.

Next, with reference to the timing chart shown in FIG. 8, description will be given of the operation of driving a panel display device which is a second embodiment of the present invention.

Here, the drive circuit for the panel display device may be configured the same as in the first embodiment of the present invention.

In the period $P_1$, the switch circuits $SWs_P$ are turned OFF as shown in FIG. 4. The switch circuit $SWc_1$ is connected to the power supply potential Vcc. Then, the voltage control circuit 12 turns ON the switch circuits $SWv_P$ to charge the loads of the organic EL devices $PE_{P,Q}$ up to a certain potential (target potential Vsm). Consequently, discharging is achieved in H level.

Subsequently, in the period $P_2$, as shown in FIG. 5, the voltage control circuit 12 turns OFF the switch circuits $SWv_P$, so that the potentials of the data lines $SEG_P$ are kept at a certain potential (Vsm±α; α is arbitrary). At time t4, as shown in FIG. 6, the switch circuit $SWs_2$ is connected to the constant current source 11 immediately. The switch circuits on the unselected data lines are connected to the ground potential Vss, and the switch circuit $SWc_2$ is connected to the ground potential Vss so that the organic EL device $PE_{2,2}$ emits light.

As described above, according to the second embodiment of the present invention, the charged organic EL devices will not be discharged temporarily. In other words, the charges in the organic EL devices will not be reset to zero. This allows a significant reduction in power consumption.

It is understood that the foregoing description and accompanying drawings set forth the preferred embodiments of the invention at the present time. Various modifications, additions and alternatives will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

This application is based on a Japanese Patent Application No. 2004-223073 which is hereby incorporated by reference.

What is claimed is:

1. A drive circuit for a panel display device for driving light-emitting devices arranged at respective intersections between a plurality of data lines and a plurality of scan lines, the drive circuit comprising:

a voltage control circuit for charging said light-emitting devices to a voltage necessary for light emission by connecting said data lines to a predetermined power supply potential in a rising period prior to a period for selectively causing said light-emitting devices to emit light; and a drive control circuit for selectively connecting said data lines to a constant current source after said rising period, wherein said drive control circuit includes a first switch circuit for connecting each of said data lines to either one of said constant current source and a ground potential; and a second switch circuit for connecting each of said scan lines to either one of a power supply potential and a ground potential, wherein said voltage control circuit includes a third switch circuit for connecting or disconnecting each of said data lines to/from said predetermined power supply potential, and said light-emitting devices are selected or deselected by said first and second switch circuits, wherein when said light-emitting devices are selected, said second switch circuit connects said scan lines to said ground potential while said third switch circuit charges said light-emitting devices by connecting said data lines to said predetermined power supply potential for a predetermined period, and then said first switch circuit selectively causes said light-emitting devices to emit light by selectively connecting said data lines to said constant current source, and wherein when said light-emitting devices are not selected, said second switch circuit connects said scan lines to said power supply potential while said first switch circuit connects said data lines to said ground potential.

2. The drive circuit for a panel display device according to claim 1, wherein said drive control circuit is composed of PMOS and NMOS transistors.

3. The drive circuit for a panel display device according to claim 1, wherein said light-emitting devices are organic EL devices.

4. The drive circuit for a panel display device according to claim 1, wherein said drive control circuit resets said light-emitting devices in a discharge period prior to said rising period.

5. The drive circuit for a panel display device according to claim 4, wherein said light-emitting devices are reset by connecting all said plurality of data lines and said plurality of scan lines to the ground potential.

6. A drive method for a panel display device for driving light-emitting devices arranged at respective intersections between a plurality of data lines and a plurality of scan lines, the drive method comprising the steps of:

charging said light-emitting devices to a voltage necessary for light emission by connecting said data lines to a predetermined power supply potential in a rising period prior to a period for selectively causing said light-emitting devices to emit light; and selectively connecting said data lines to a constant current source after said rising period, wherein said step of charging said light-emitting devices includes connecting said scan lines to a ground potential while connecting said data lines to said predetermined power supply potential for a predetermined period, and wherein said drive method further comprises the step of connecting said scan lines to said power supply potential while connecting said data lines connected to unselected light-emitting devices to said ground potential after said rising period.

7. The drive method for a panel display device according to claim 6, further comprising the step of resetting said light-emitting devices in a discharge period prior to said rising period.

8. The drive method for a panel display device according to claim 7, wherein said light-emitting devices are reset by connecting all said plurality of data lines and said plurality of scan lines to the ground potential.

9. The drive method for a panel display device according to claim 6, further comprising the step of resetting said light-emitting devices by connecting all said plurality of data lines and said plurality of scan lines to the ground potential in a discharge period prior to said rising period.

10. A drive circuit for a panel display device for driving light-emitting devices arranged at respective intersections between a plurality of data lines and a plurality of scan lines, the drive circuit comprising:

a voltage control circuit for charging said light-emitting devices to a voltage necessary for light emission by connecting said data lines to a predetermined power supply potential in a rising period prior to a period for selectively causing said light-emitting devices to emit light; and a drive control circuit for selectively connecting said data lines to a constant current source after said rising period, wherein said voltage control circuit includes:

a register circuit for storing setting data;

a counter circuit for counting the number of clock pulses to provide a count value; and a circuit for connecting said data lines to said predetermined supply potential before said count value reaches a value indicated by said setting data.

11. The drive circuit for a panel display device according to claim 10, wherein said drive control circuit is composed of PMOS and NMOS transistors.

12. The drive circuit for a panel display device according to claim 10, wherein said light-emitting devices are organic EL devices.

13. The drive circuit for a panel display device according to claim 10, wherein said drive control circuit resets said light-emitting devices in a discharge period prior to said rising period.

14. The drive circuit for a panel display device according to claim 13, wherein said light-emitting devices are reset by connecting all said plurality of data lines and said plurality of scan lines to the ground potential.

* * * * *

UNITED STATES PATENT AND TRADEMARK OFFICE

CERTIFICATE OF CORRECTION

PATENT NO. : 7,586,471 B2
APPLICATION NO. : 11/190850
DATED : September 8, 2009
INVENTOR(S) : Satoh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1076 days.

Signed and Sealed this

Fourteenth Day of September, 2010

David J. Kappos

David J. Kappos
*Director of the United States Patent and Trademark Office*